US005693898A

United States Patent [19]

Fishman

[11] Patent Number: 5,693,898

[45] Date of Patent: Dec. 2, 1997

[54] HINGED CONTROL PANEL FOR ELECTRIFIED ACOUSTIC GUITAR

[76] Inventor: Lawrence R. Fishman, 22 Calumet Rd., Winchester, Mass. 01890

[21] Appl. No.: 614,781

[22] Filed: Mar. 8, 1996

[51] Int. Cl.[6] ..... G10D 1/08

[52] U.S. Cl. ..... 84/267; 84/291; 84/743

[58] Field of Search ..... 84/267, 291, 743

[56] References Cited

U.S. PATENT DOCUMENTS 4,351,217 9/1982 Wechter ..... 84/1.16

*Primary Examiner*—Michael L. Gellner
*Assistant Examiner*—Shih-yung Hsieh
*Attorney, Agent, or Firm*—Wolf, Greenfield & Sacks, P.C.

[57] ABSTRACT

A control panel is attached to an acoustic guitar in order to provide electrical amplification and sound processing. The control panel includes a flexible outer bracket fixed to a curved surface of the guitar body and a face plate hingedly connected to the outer bracket. A circuit board including processing circuitry is connected to the underside of the face plate. A battery compartment is connected to the underside of the face plate. The face plate is releasably connected to the outer bracket so that it can be rotated about the hinged portion to access the battery compartment.

13 Claims, 3 Drawing Sheets

HINGED CONTROL PANEL FOR ELECTRIFIED ACOUSTIC GUITAR

BACKGROUND OF THE INVENTION

1. Field of the Invention

The present invention relates to control panels for signal processing circuitry in electrified acoustic guitars. More particularly, it relates to a control panel which can be attached to different guitars and which has a battery compartment which is easily accessible.

2. Discussion of the Related Art

To electrify an acoustic guitar, pickups for generating electronic signals from the strings and circuitry for processing the electronic signals must be added. The processing circuitry is used to alter the quality of the sound. For example, various ranges of notes, such as treble or bass, can be emphasized or de-emphasized. Similarly, the volume and phase can be controlled. In order to allow the user to adjust the processing of the electronic signal, a control panel having various knobs and buttons is attached in the body of the guitar. To attach the control panel, a hole is cut in the body of the guitar, typically on the side. The processing circuitry and control panel are inserted into the body cavity and attached to the side. Wires extend from the processing circuitry to pickups by the strings and to an output jack toward the base of the guitar. The hole weakens the body of the guitar and should be as small as possible.

The processing circuitry is powered by batteries contained within the body of the guitar. The replacement of the batteries, when they become low, can be difficult. If the battery is positioned behind the control panel, the control panel can be removed to access the batteries The batteries can also be changed through the sound hole in the front of the guitar. The strings must be loosened in order to reach into the sound hole. Also, the batteries are typically not visible which makes changing them more difficult. Alternatively, the batteries may be contained in a compartment with a cover on the face of the control panel. Although the cover may be easier to remove in order to change the batteries, it increases the costs of manufacturing the control panel in order to include the compartment and cover, and requires a larger hole on the guitar body.

Therefore, a need exists for a control panel having a battery compartment which is easily accessible without extra machining or part costs and while minimizing the hole size to accommodate the control panel, processing circuitry and battery compartment.

Also, the side of the guitar to which the control panel is attached is curved. Different makes and models have different curvatures. The curvature may also vary for a single guitar depending upon the location along the side. Control panels with different curvatures are needed for attaching to different guitars or locations.

Therefore, a need exists for a control panel which can be attached to guitars with different curvatures.

SUMMARY OF THE INVENTION

The present invention substantially overcomes the deficiencies of the prior art through a control panel which provides easy access to a battery compartment located behind it. In one aspect of the present invention, the control panel includes a hinged face plate. The knobs, buttons, sliders, and other control elements are included on the hinged portion of the face plate. The processing circuitry is included on a circuit board directly behind the face plate and connected to the control elements on the face plate.

According to another aspect of the invention, the battery compartment is attached directly to the back side of the circuit board including the processing circuitry. The face plate, processing circuitry and battery compartment are positioned such that the combined structure can be rotated out of the face plate hole. Thus, easy access is provided to the battery compartment.

According to another aspect of the invention, a face plate is hinged to a outer bracket towards one end. The face plate is releasably connected at the other end so that it can be rotated about the hinged end to permit access to the under side of the face plate.

According to another aspect of the invention, the outer bracket of the control panel is flexible so that it can be attached to guitars with different curvatures. The face plate is connected to the outer bracket in a manner to accommodate bending of the outer bracket.

With these objectives, advantages and features of the present invention and others which may become apparent, the nature of the invention may be more clearly understood with respect to the following description and the drawings attached hereto.

DETAILED DESCRIPTION

Figure 1:
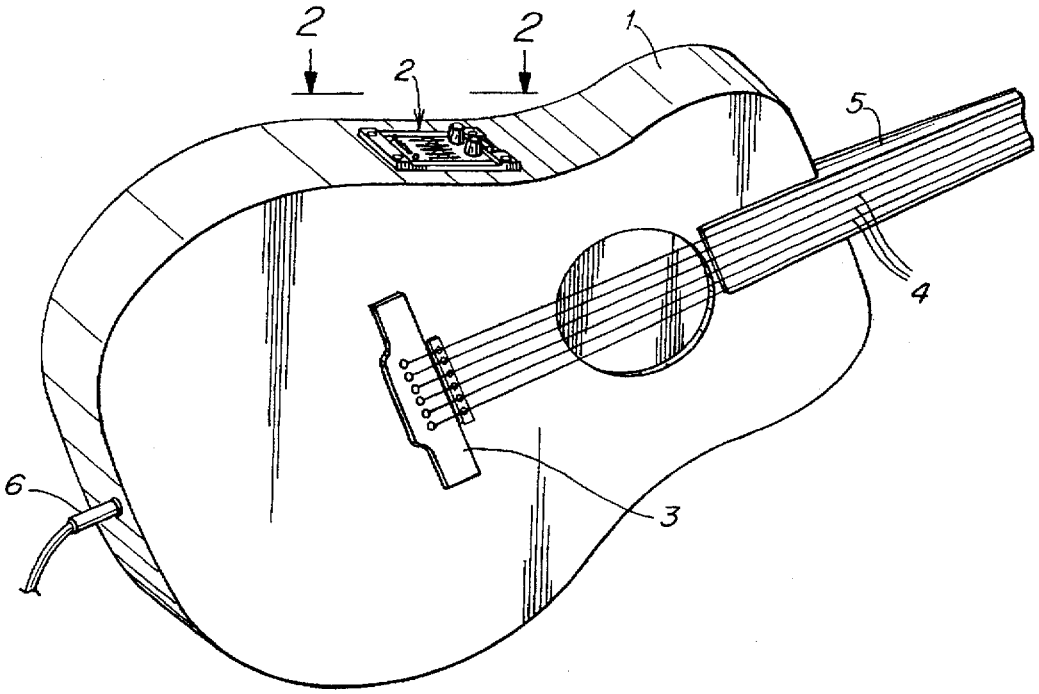
FIG. 1 is a perspective view of a guitar including a control panel according to the present invention.

FIG. 1 illustrates a top perspective view of an acoustic guitar having a control panel according to the present invention. The guitar includes a body 1 and neck 5. The strings 4 are attached to the guitar body 1, pass across a bridge 3, and are attached to the far end of the neck 5. In order to electrify the guitar, control panel 2 and signal processing circuitry are included in the top side of the guitar. The processing circuitry is connected to pickups contained in or near the bridge 3 in order to generate electrical signals based upon string vibrations. The processing circuitry is also connected to an output jack 6 at the base of the guitar which can be connected to an external circuit for amplification.

Figure 2:
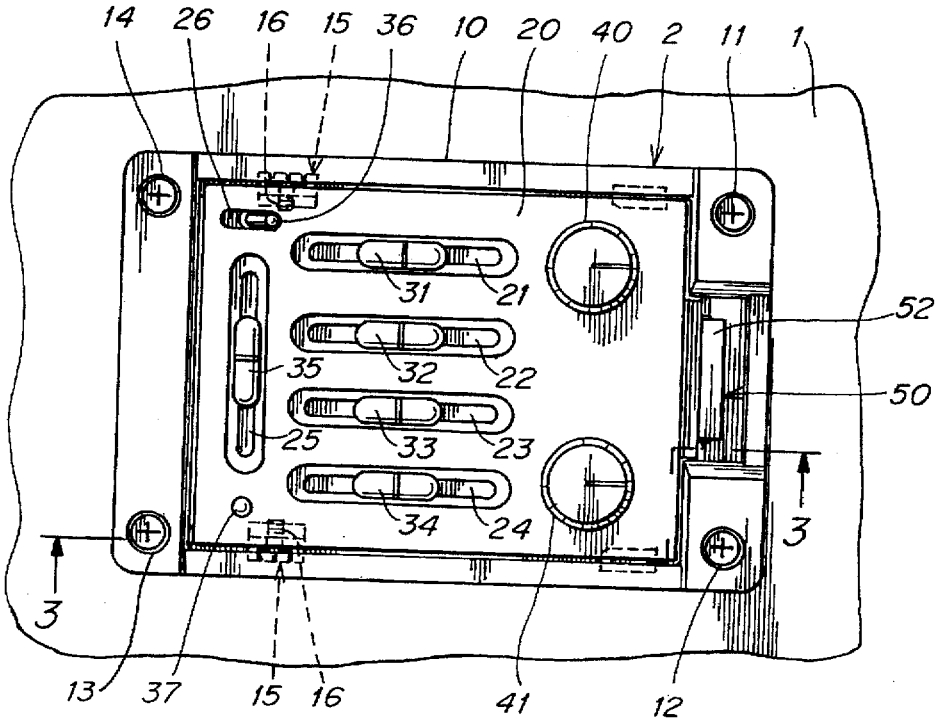
FIG. 2 is a top view of the control panel of the present invention as seen along lines 2—2 of FIG 1.

FIG. 2 illustrates a top view of the control panel 2 of the present invention. The control panel 2 includes an outer bracket 10 and a face plate 20. Outer bracket 10 includes screw holes 11–14, through which screws are passed to attach the control panel to the guitar panel 1. The outer bracket is flexible; it can be bent to conform to the shape of the side of the guitar. The face plate 20 is hinged at one end to the outer bracket 10. At the opposite end, the face plate includes a releasable clip 50, which interacts with the outer bracket 10 to maintain the face plate in position. The hinge 15 and releasable clip 50 permit some movement of the face plate relative to the outer bracket. Thus, the face plate 20 can remain flat within the curved outer bracket 10.

FIG. 2 also illustrates possible control elements on the face plate. These control elements can include slots 21–25 with sliders 31–35, rotatable knobs 40, 41, and switch 36 in a slot 26. The control elements can be placed in any position and be of any type which is useful for connection to processing circuitry to control signal processing. Light emitting diodes (LED) 37 may also be used to indicate conditions of the processing control circuitry, such as when the power is on or when the battery is low.

Figure 3:
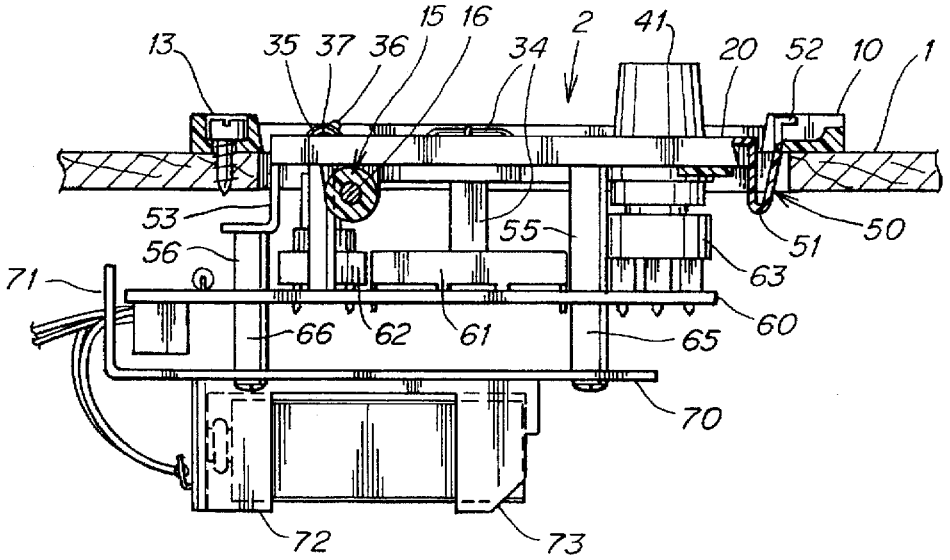
FIG. 3 is a cross sectional view of the control panel of the present invention taken along line, 3—3 of FIG. 2.

FIG. 3 illustrates a cross sectional view of the control panel according to a embodiment of the present invention. A circuit board 60 containing the processing circuitry is attached to the under side of the face plate by posts 55, 56. Control devices 61, 62, 63, 64 are attached to the circuit board and to the control elements on the front side of the face plate.

It is illustrated in FIG. 3, a hinge structure 15 with an axis pin 16 is positioned towards one end of the control panel to connect the outer bracket 10 to the face plate 20. The releasable clip 50 at the other end of the control panel can be a U-shaped member 51 which engages the outer bracket 10 at an external end 52 of the U-shaped member 51. Flexing of the U-shaped member 51 allows movement of the face plate 20 relative to the outer bracket 10 to accommodate different guitar curvatures. In order to release the face plate, the user may press the external end 52, causing the U-shaped member 51 to flex inwardly and disengage the external end 52 from the outside bracket 10. The face plate then can freely rotate about the axis pin 16 of the hinge structure 50.

The battery compartment is located on an under side of the circuit board 60. A base plate 70 is attached by posts 65, 66 to the circuit board 60. The posts 65, 66, 55, 56 can include any method of attaching the circuit board 60 to the bottom plate 70 and the face plate 20. For example, posts can be formed from a plastic material of a face plate and glued to the circuit board. Alternatively, pins can extend through the face plate 20, circuit board 60, and base plate 70 to form the posts. On the under side of the base plate 70 is the battery compartment, including two protective members 72, 73. An electrical connection is included in at least one of the protective members 72, 73 for attaching the battery electrically to the circuit board 60.

Figure 4:
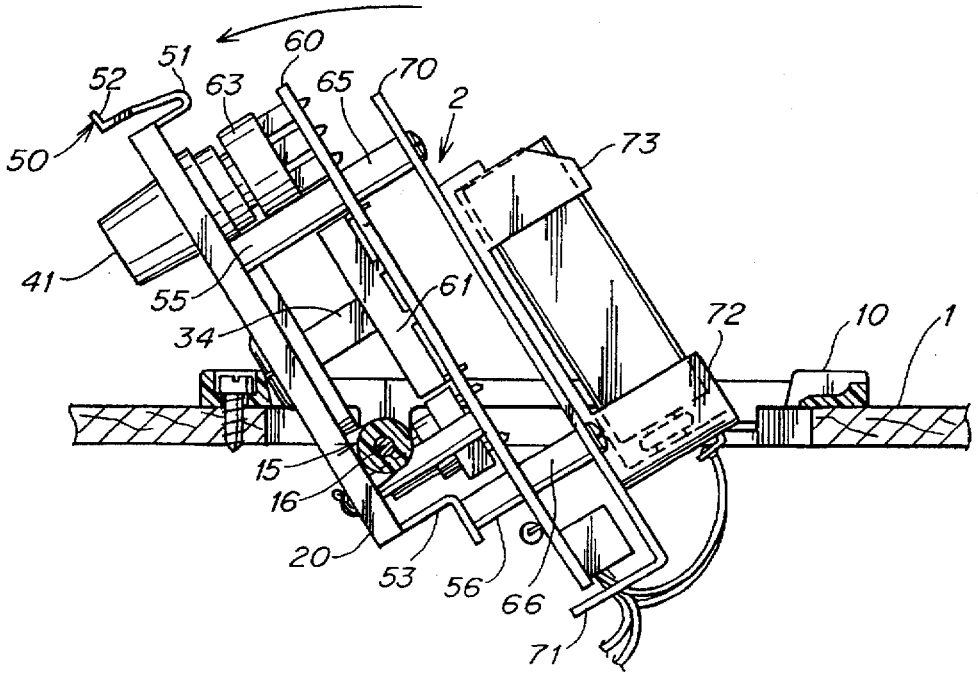
FIG. 4 is another cross sectional view of the control panel of the present invention in an open position.

FIG. 4 illustrates the control panel of the present invention in an open position to allow access to the battery compartment. When the releasable clip 50 has been released, the face plate can rotate on the axis of the hinge structure 15 through the outer bracket in order to expose the under side of the control panel and the battery compartment. The face plate 20, circuit board 60, and base plate 70, are positioned obliquely from each other to facilitate rotation of the control panel from a closed position to an open position. In order to protect the circuit board, the face plate may include an extension 53 extending downwardly from the hinged end of the face plate to attached to the end of the circuit board 60 by posts 56. Additionally, the base plate 70 can include a protective member 71 extending substantially perpendicular to the base plate at the hinged end of the circuit board.

Figure 5:
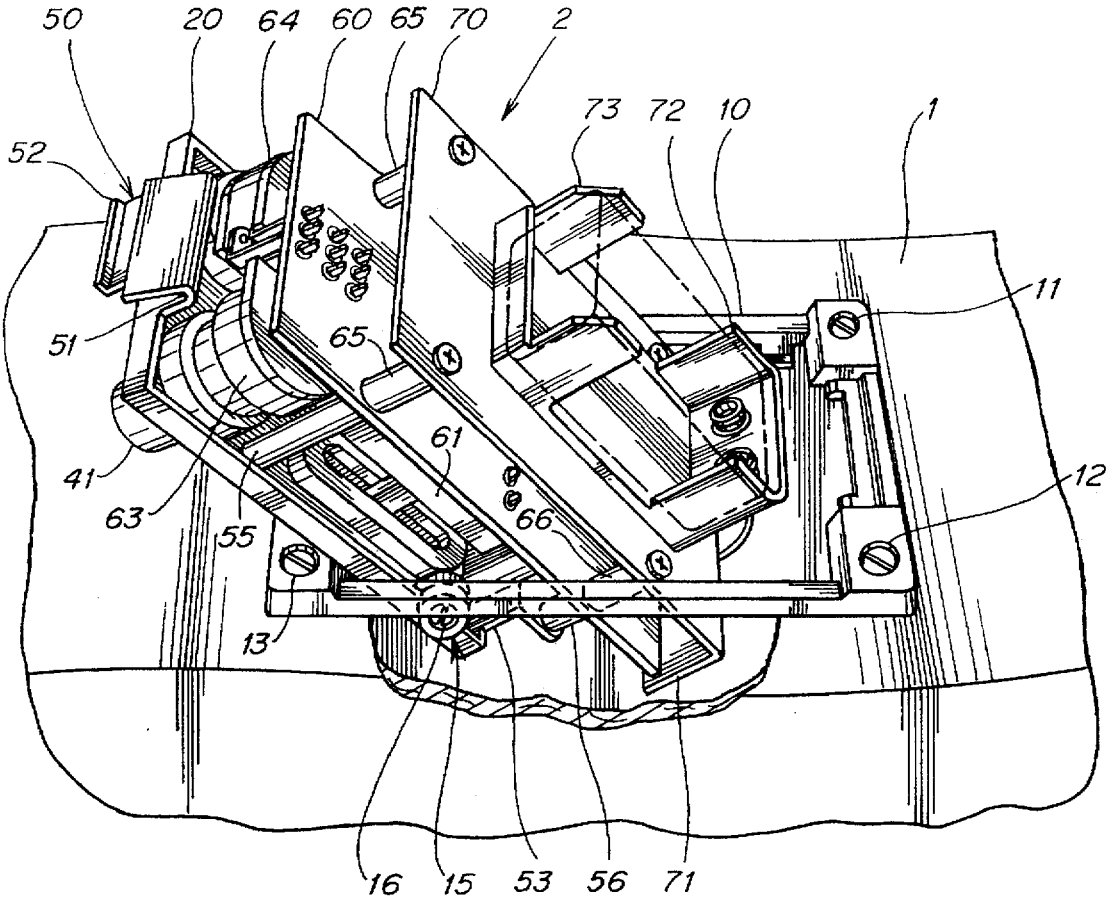
FIG. 5 is a perspective view of the present invention in an open position.

FIG. 5 illustrates the interaction between the outer bracket 10 and the face plate 20 in a fully open position. The releasable clip 50 maintains the face plate 20 in a closed position with the outer bracket 10, When released, it allows the face plate 20 to rotate about the hinge to allow access to the under side. Of course, the face plate could be hinged and releasably connected in a different manner as long as it can still be rotated to provide access to the circuit board and battery compartment on the under side of the face plate.

Having thus described at least one embodiment of the present invention, alterations, modifications and variations will be apparent to those ordinary skilled in the art. Such alterations, modifications and variations are considered to be part of the present invention which are limited solely by the claims appended hereto.

What is claimed is:

1. A control panel for electrification of an acoustic guitar comprising:

an outer bracket attachable to the body of the guitar;

a face plate hingedly connected at a first end to the outer bracket; and a battery compartment attached to an underside of said face plate so as to be disposed within the guitar body when the control panel is attached to the guitar;

wherein said face plate and battery compartment are disposed so that said face plate can rotate about said first end to expose said battery compartment on the underside of the face plate.

2. The control panel of claim 1, wherein said face plate includes at least one control element for adjusting the processing of electrical signals from said guitar.

3. The control panel of claim 1, further comprising:

a circuit board, including processing circuitry, attached to the underside of said face plate, between said face plate and said battery compartment.

4. The control panel of claim 3, wherein said control elements are attached to the processing circuitry.

5. The control panel of claim 1, wherein said face plate includes a connector at an end opposite said hinged end for releasably connecting said face plate to said outer bracket.

6. The control panel of claim 1, wherein said outer bracket is rectangularly shaped and surrounds said face plate on four sides.

7. The control panel of claim 1, wherein said outer bracket is flexible so that it can bend along a curvature of the body of the guitar.

8. A control panel for electrification of an acoustic guitar comprising:

a flexible, planar outer bracket attachable along a curved surface of a body of a guitar;

a planar face plate; and attachment means for connecting said face plate to said outer bracket so that said face plate remains planar when said outer bracket is curved, wherein said attachment means includes a hinge structure at a first end of said face plate.

9. The control panel of claim 8, wherein said attachment means includes a connector for releasably connecting said face plate to said outer bracket.

10. The control panel of claim 8, further comprising a battery compartment attached to the underside of said face plate, wherein said face plate and battery compartment are disposed so that said face plate can rotate about said first end to expose said battery compartment on the underside of the face plate.

11. A method for attaching a face plate of a control panel to a side of a guitar body comprising the steps of:

attaching said face plate to a flexible, planar outer bracket including the step of connecting said face plate to said outer bracket by a hinge toward a first end of said face plate;

bending said outer bracket to conform to a curvature along said side of said guitar, while maintaining said face plate planar; and attaching said outer bracket to said side of said guitar.

12. The method of claim 10, wherein said first attaching step includes the step of releasably connecting said face plate to said outer bracket at a second end opposite said first end.

13. The method of claim 12, further comprising the step of attaching a battery compartment to the underside of said face plate.

* * * * *

UNITED STATES PATENT AND TRADEMARK OFFICE
Certificate

Patent No. 5,693,898 Patented: December 2, 1997

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Lawrence R. Fishman, Winchester, MA (US); and Scott Lefton, Melrose, MA (US).

Signed and Sealed this Fifth Day of September 2006.

DAVID MARTIN
*Supervisory Patent Examiner*
Art Unit 2837